US008469100B2

(12) United States Patent
Irvine et al.

(10) Patent No.: US 8,469,100 B2
(45) Date of Patent: Jun. 25, 2013

(54) INTEGRATED FLUID FILTRATION AND RECIRCULATION SYSTEM AND METHOD

(75) Inventors: William O. Irvine, Lakewood, CO (US); Benjamin Allen Galassini, Littleton, CO (US)

(73) Assignee: Engineering Fluid Solutions, LLC, Arvada, CO (US)

( * ) Notice: Subject to any disclaimer, the term of this patent is extended or adjusted under 35 U.S.C. 154(b) by 629 days.

(21) Appl. No.: 12/535,565

(22) Filed: Aug. 4, 2009

(65) Prior Publication Data

US 2011/0030951 A1 Feb. 10, 2011

(51) Int. Cl.
*E21B 37/08* (2006.01)

(52) U.S. Cl.
USPC ..... 166/311; 166/267; 175/66; 210/741

(58) Field of Classification Search
USPC ..... 166/75.11, 75.12, 267, 311; 175/66; 210/241, 741
See application file for complete search history.

(56) References Cited

U.S. PATENT DOCUMENTS 4,383,920 A * 5/1983 Muller et al. ..... 210/87
4,659,460 A * 4/1987 Muller et al. ..... 210/93
4,664,798 A * 5/1987 Bergh ..... 210/241
4,744,420 A 5/1988 Patterson et al.
4,919,204 A 4/1990 Baker et al.
5,102,503 A * 4/1992 Silinski et al. ..... 202/83
5,141,653 A * 8/1992 Smith et al. ..... 210/806
6,393,775 B1 * 5/2002 Staschik ..... 52/79.1
7,377,283 B2 5/2008 Walker et al.
7,549,468 B2 6/2009 Pleskie
2009/0057237 A1 * 3/2009 Slabaugh et al. ..... 210/724

OTHER PUBLICATIONS

"Backwash Filter Systems & Self Cleaning Automatic Backwash Filter Systems," Ascension Industries, Inc., available at http://www.asmfab.com/Automatic-Backwash-Filters.aspx, date unknown.
"V Series Automatic Filter," Valve and Filter, 2005, 2 pages.

* cited by examiner

*Primary Examiner* — Duane Smith
*Assistant Examiner* — Paul J Durand
(74) *Attorney, Agent, or Firm* — Sheridan Ross PC

(57) ABSTRACT

An integrated fluid filtration and recirculation system and method are provided for re-circulating and filtering fluid that is used in well cleaning operations. The system is incorporated within an enclosure, which is transportable, such as on a vehicle trailer. The system has power generation capability, thereby making the system capable of operating as a stand-alone unit. Chemicals may be infused into the filtered fluid from an integral chemical supply allowing the system to also function as a treatment facility for the fluid. The components of the system are arranged in a linear fashion that enables the system to maintain a minimum profile for transport upon a conventional trailer, yet the system provides enough room within the enclosure to allow operators to repair/inspect each of the system components. The enclosure may be climate controlled, and the enclosure may include removable panels for operation of the system in temperate conditions when climate control is unnecessary.

3 Claims, 5 Drawing Sheets

INTEGRATED FLUID FILTRATION AND RECIRCULATION SYSTEM AND METHOD

FIELD OF THE INVENTION

The present invention relates to self-contained, mobile, fluid filtration systems, and more particularly, to an integrated fluid filtration and recirculation system and method especially adapted for filtration and recycling of cleaning fluids used to clean the bore of a well.

BACKGROUND OF THE INVENTION

A number of systems have been developed for evacuating accumulations of blockages in wellbores to include oil and gas producing wells. The blockages may include accumulations of sediments and other solids generated from the well. A well is typically lined at the upper portion with a casing, and the down-hole portion is lined with metallic, plastic, or other liners, sometimes referred to as "well tubulars". The tubulars may be in the form of production tubing, and slotted or wire-wrapped liners. The well tubulars may be particularly susceptible to corrosion, and deposits may develop on the tubulars such as silicates, sulfates, sulfides, carbonates, calcium and organic growth.

One solution for performing well cleaning operations is to utilize a cleaning implement placed down-hole that also carries a cleaning solution. The cleaning implement forms the distal end of a tubular member placed down-hole, referred to as coiled tubing. The coiled tubing is placed into the well to perform the cleaning operation to include the injection of treating and cleaning fluids, which remove blockages and otherwise clean the well tubulars. The circulation and cleaning fluid may include water, acid, foam, chemical cleaning solutions, and corrosion inhibitors.

It is desirable to perform an efficient well cleaning operation in which the coiled tubing is advanced into the well as quickly as possible, and then the fluid is injected into the well. The cleaning implement in conjunction with the cleaning fluid provides both mechanical and fluid/chemical cleaning which under most circumstances adequately cleans the wellbore.

Depending upon the depth and number of wells to be cleaned, a significant amount of cleaning fluids may be required to adequately clean the targeted wells. Because of environmental concerns in most locations, the cleaning fluids cannot be disposed of by allowing the fluid to be dumped onto the surrounding land. Therefore, there is an operational requirement to prevent the cleaning fluids from contacting the ground. Significant measures are taken to retrieve the used cleaning fluids in order to dispose of the fluids in an environmentally responsible manner.

One system disclosed for cleaning a well is found in U.S. Pat. No. 4,919,204. This reference more specifically discloses a cleaning apparatus for pressurized cleaning of well flow conductors. The apparatus provides cleaning of the conductors by use of the apparatus in combination with high pressure directed fluid jets that flow through the apparatus. Rotation of the cleaning apparatus can also be used for combined mechanical and hydraulic drilling to remove deposits from within the well flow conductors. The reference discloses coiled tubing mounted on a reel, and the reel itself is mounted on a vehicle. A manifold is connected to the coiled tubing. The manifold includes the necessary pumps, valves, and fluid reservoirs to discharge high pressure cleaning fluid through the coiled tubing into the wellbore.

Another example of a system for cleaning a well is disclosed in the U.S. Pat. No. 7,549,468. Specifically, the reference discloses a coiled tubing injector system which includes transport trailer components for separate transfer to and from a drilling site. Each component is taken to the site with its own transport tractor, a first component including a coil storage reel and a second component including a tubing injector carried on a mast which is raised from a horizontal transport position, through a stabbing and unstabbing position to a raised working position. When the components are arranged together in an end-to-end with the mast in a stabbing position, a tube gripping member is positioned between the storage reel and tubing injector for controlling the handling of a free end of the stored tubing for stabbing and unstabbing of the tubing injector Other examples of wellbore cleaning devices include the U.S. Pat. Nos. 4,744,420 and 7,377,283.

As environmental regulations become more stringent, particularly in areas such as the Arctic, extreme measures have to be taken to prevent the inadvertent spillage of any cleaning fluid. The cleaning fluid cannot be permanently stored and treated at the well location and, therefore, once the cleaning fluid is spent, the cleaning fluid must be trucked offsite to a treatment facility. Often times, the treatment facility is many hundreds of miles from the well locations. Thus, one significant problem with well cleaning operations is the time and expense involved with trucking the needed cleaning fluid to and from the well locations.

Therefore, there is a need to provide a well cleaning system in which the logistics associated with use of the cleaning fluid are simplified and made more efficient. Furthermore, there is also a need to greatly conserve the use of the cleaning fluid, not only for purposes of addressing the logistical concerns, but also to reduce the risk that a significant amount of cleaning fluid could be inadvertently spilled.

There is also a need to provide an integrated cleaning solution in which the system can be easily transported to remote locations where vehicle access is limited to off-road type vehicles or vehicles that otherwise can travel on unimproved roads.

There is also a need to provide a cleaning solution that is self contained and automated which reduces manpower requirements and allows remote control of the system which may be installed at remote geographical locations.

SUMMARY OF THE INVENTION

In accordance with the present invention, a system and method are provided for an integrated fluid filtration and recirculation system that is especially adapted for filtering and re-circulating well cleaning and treatment fluid (referred to hereinafter collectively as "cleaning fluid"). With the method and system of the present invention, well cleaning fluid may be conserved by filtering and re-circulating used cleaning fluid back to the well for further cleaning operations. Thus, the cleaning fluid may be recycled a number of times before having to be evacuated from the site. The filtering and recycling of the cleaning fluid greatly conserves the amount of cleaning fluid required, and provides great economic savings and logistical savings with respect to the effort otherwise necessary to truck the cleaning fluid to and from the well locations.

The integrated fluid filtration and recirculation system of the present invention is characterized by a self-contained, automated, mobile/transportable, and efficiently sized system in which the cleaning fluid can be filtered and treated to a degree so that it may be reused in a number of subsequent cleaning cycles.

The system of the present invention includes a power generation capability for powering a pump which is capable of circulating the fluid from an intake where spent/used cleaning fluid arrives from the wellbore. The used fluid or contaminant fluid stream passes through a series of filtration elements which effectively filter the cleaning fluid so that the cleaning fluid may be reintroduced into the coiled tubing for subsequent cleaning operations.

The filtration assembly includes a primary or coarse filter that removes larger sized solids, and a secondary filtration group that provides filtration for finer particles, as well as removable of other unwanted chemical and organic contaminates in the fluid stream. The power generation capability is in the form of a generator unit that is co-mounted along with the filtration assembly within a common enclosure.

The enclosure can be insulated depending upon the environment in which the enclosure is used. The enclosure may have integral heating and cooling capabilities, such as an electric heater and an electrical air conditioning unit powered by the generator. Thus, the enclosure can be habitable, even in the most extreme climate conditions.

The enclosure itself is mounted upon a skid or base which is sized to be conveniently mounted on a standard sized hauling platform. The generator and filtration assembly are arranged so that they provide an elongated, linear configuration that is adapted for mounting on the skid/base that can be mounted upon a surface/platform that is not oversized and is capable of being transported without any size restrictions according to highway requirements. For example, the surface may be a flat bed trailer, or the system may be mounted to a hauler truck. More specifically, the generator and the filter assembly are linearly aligned and spaced from one another so that the generator and filtration assembly may be mounted for transport, yet maximum room is provided for operators to move within the enclosure that houses the generator and filtration assembly.

The enclosure itself has a number of features that allow it to be used in different climatic conditions from freezing Arctic weather, to tropical areas.

The fuel that powers the generator can be drawn directly from another vehicle by an auxiliary fuel line which interconnects the fuel system of the vehicle to the generator. Alternatively, a smaller fuel storage tank may be incorporated on the enclosure such as an exposed fuel tank mounted to the end of the enclosure closest to the generator or the fuel tank may be stored beneath the generator.

The system can be monitored and operated by a master electronic controller that can control a number of functions to include the operation of the generator, the operation of the filtration assembly, the heating/cooling of the enclosure, and various alarm conditions that can be used to shut the system down or to otherwise manipulate the system based on the volumetric and flow rate needs of the particular well being serviced.

The cleaned fluid or filtrate stream may be further treated by the introduction of additives into the filtrate stream. A dosing pump is used to convey the additives to the filtrate stream prior to the filtrate stream being conveyed back to the coiled tubing.

The present invention provides a method for cleaning, treating and re-circulating fluid for purposes of maintenance of a well. The system is self contained, transportable, and adaptable for use in varying climatic conditions.

In sub-combination, the invention also provides a functional and unique filtration assembly that is especially adapted to be trailer mounted.

In another aspect, the invention can be considered in combination with a coiled tubing system to provide a complete solution for well cleaning operations.

These and other aspects and advantages of the present invention will become clearer in a review of the following drawings, taken in conjunction with the detailed description.

DETAILED DESCRIPTION

Figure 1:
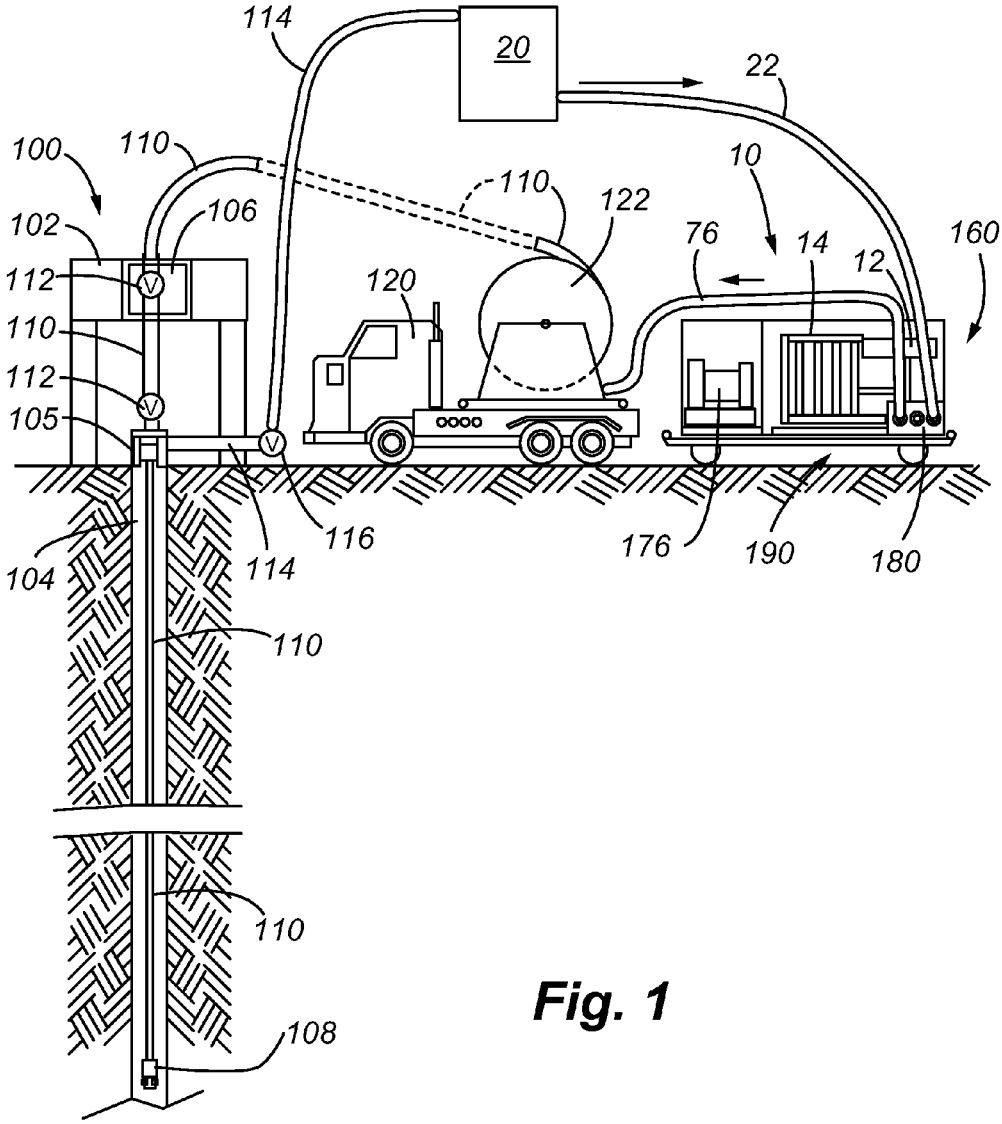
FIG. 1 is a schematic view of a well and wellhead being serviced by a coiled tubing workstation including the integrated fluid filtration and recirculation system of the present invention.

FIG. 1 illustrates a well 100 including a wellhead 102 that services a wellbore 104 that has been drilled. The well 100 may be, for example, a gas or oil producing well. A well casing 105 covers the wellbore 104. The wellbore 104 may be lined down-hole with various forms of tubulars (not shown). An injector assembly 106 is provided in the wellhead 102 for injecting cleaning fluid through coiled tubing 110 that has been placed in the wellbore. A cleaning apparatus 108 may be disposed at the distal end of the coiled tubing 110, and the apparatus 108 constitutes the most forward portion of the coiled tubing advanced through the wellbore. One or more control valves 112 may control the amount of cleaning fluid introduced through the coiled tubing 110. The cleaning fluid is introduced through the coiled tubing and strikes the wellbore once it discharges at the location of the cleaning apparatus 108. The used, discharged fluid then fills the wellbore and is evacuated through return line 114. Depending upon the type of cleaning apparatus, the used fluid may also be pumped to the surface through another line (not shown) placed coaxially within the coiled tubing. One or more transport pumps (not shown) may be incorporated with return valve 116 in order to transport the used/spent cleaning fluid to a pre-treatment station 20. The pre-treatment station 20 may be, for example, a settling tank. The fluid is then conveyed from the pre-treatment station through inlet line 22 to the filtration assembly 10 of the present invention.

The coiled tubing 110 is paid-out from a dispensing reel 122 which may be, for example, mounted on a vehicle 120. The vehicle 120 may include a manifold (not shown) for receiving filtered/treated cleaning fluid through line 76, which thereby reintroduces the filtered/treated cleaning fluid for subsequent cleaning operations.

Figure 2:
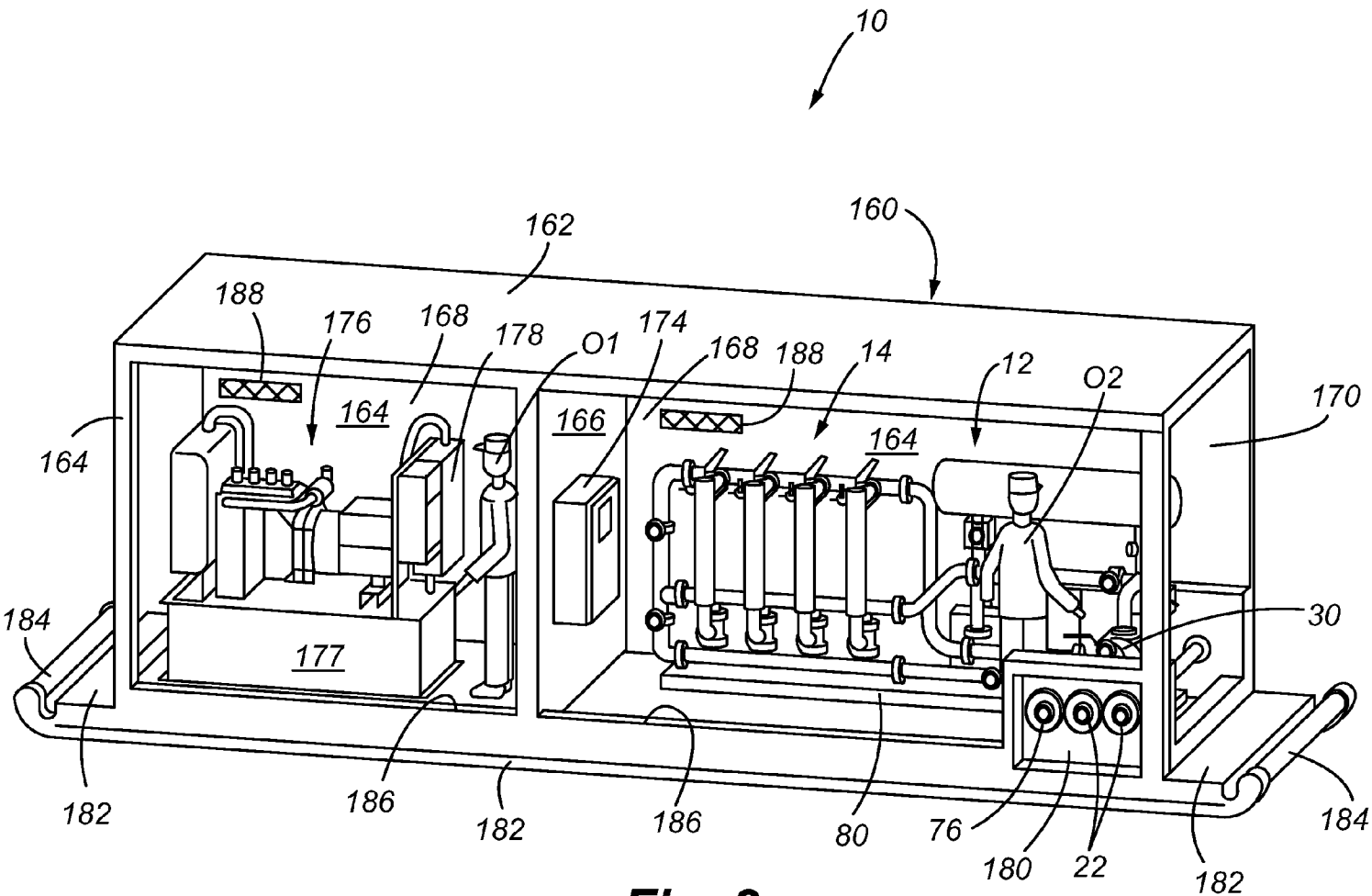
FIG. 2 is a perspective view of the system of the present invention as incorporated within the enclosure.

Referring also to FIG. 2, the system of the present invention is integrated with an enclosure 160. The filtration assembly includes a primary filtration station 12 and a secondary filtration station 14. A generator 176 provides power for a filtration pump 30 which circulates the fluid through the filtration assembly 10. The spent/used cleaning fluid enters the filtration assembly through one or more inlet lines 22. The filtered cleaning fluid or filtrate stream exits the filtration assembly through discharge line 76 that interconnects the filtrate stream with the manifold of the coiled tubing dispenser 122 (FIG. 1).

With respect to the construction of the enclosure 160, it provides a convenient, economical, and adaptable solution for cleaning/treating a fluid circulated through the filtration assembly. The enclosure is characterized by a roof 162, sidewalls 164, and an internal firewall 166 that separates two rooms, one room which houses the generator 176, and the other room which houses the filtration assembly. Respective doors (not shown) are used to access each of the rooms. The enclosure may be completely enclosed by sidewalls, or one or more of the sidewalls may incorporate removable panels (not shown), thereby exposing the generator and filtration assembly. In temperate climates, the removable panels may be advantageous, while providing a completely closed enclosure may be an optimal solution for extreme climate conditions, such as Arctic or desert conditions. As shown, two side openings 168 are provided, and these may be closed or may receive the removable panels. The FIG. 2 also illustrates one end opening 170 which may receive either a removable panel or an access door.

A main control panel 174 can be mounted on the internal firewall as shown. The control panel 174 houses the main controller 200. The functions of the main controller 200 are discussed further below. Optionally, the generator 176 may have its own generator control panel 178 that allows local operation and monitoring of the generator 176. Two operators O1 and O2 are shown attending to the system. The enclosure is sized so that the operators have adequate room to access system components for repair, operation, and preventative maintenance. Although two operators are shown for purposes of illustrating the relative size of a person as compared to the size of the enclosed space provided by the enclosure, it shall be understood that one main objective of the main controller 200 is to provide an automatically controlled system which minimizes the necessity for operators to attend to the system. Of course, some preventative maintenance has to occur over time, but the system does not require monitoring by an operator on a continual basis.

The generator and filtration assemblies are both mounted on a common pallet or skid 182. This pallet 182 is sized to fit within the dimensions of the trailer or haul vehicle carrying the system. For example, a standard trailer of a tractor-trailer rig may have a dimension of approximately 52 feet in length and 8.5 feet in width. The pallet 182 is sized to fit within this profile or a smaller length. A pair of hoisting bars 184 is disposed at opposite ends of the pallet, which enables the pallet to be lifted and moved from the trailer/vehicle that carries the system.

The lower portion of the enclosure includes raised edges constituting a spill containment lip 186 that prevents fluids leaking from the generator or filtration assembly from spilling out of the enclosure onto the surrounding ground. The spill containment lip 186 may be sized in height to accommodate a worst case scenario, i.e., a scenario in which substantially all of the fluids in the filtration assembly at any particular time were spilled to include the fluid being filtered as well as operating fluids such as hydraulic fluid and fuel. Thus, the height of the spill containment lip 186 would be sized as a function of the volume necessary in the filtration assembly room to capture the fluid.

Each of the rooms also includes respective heating/cooling vents 188 which communicate with integral heating elements (not shown) and/or air conditioning elements (not shown). These heating/cooling units could be mounted to the ceiling or the sidewalls.

A bulkhead support 180 is located on both opposite sides of the walls of the enclosure. The supports 180 include one or more openings that receive the inlet/discharge lines from the filtration assembly. FIG. 2 only shows one support 180, but it shall be understood that the opposite side of the enclosure would also have a bulkhead support 180 for receiving the inlet/discharge lines extending towards that side of the enclosure.

FIG. 1 shows the enclosure 160 of the present invention mounted on a trailer 190. However, it shall be understood that the enclosure 160 can also be mounted on a hauler truck or other flat surface that is sized to meet federal and state highway size specifications in order to avoid special permits for oversized loads.

Figure 3:
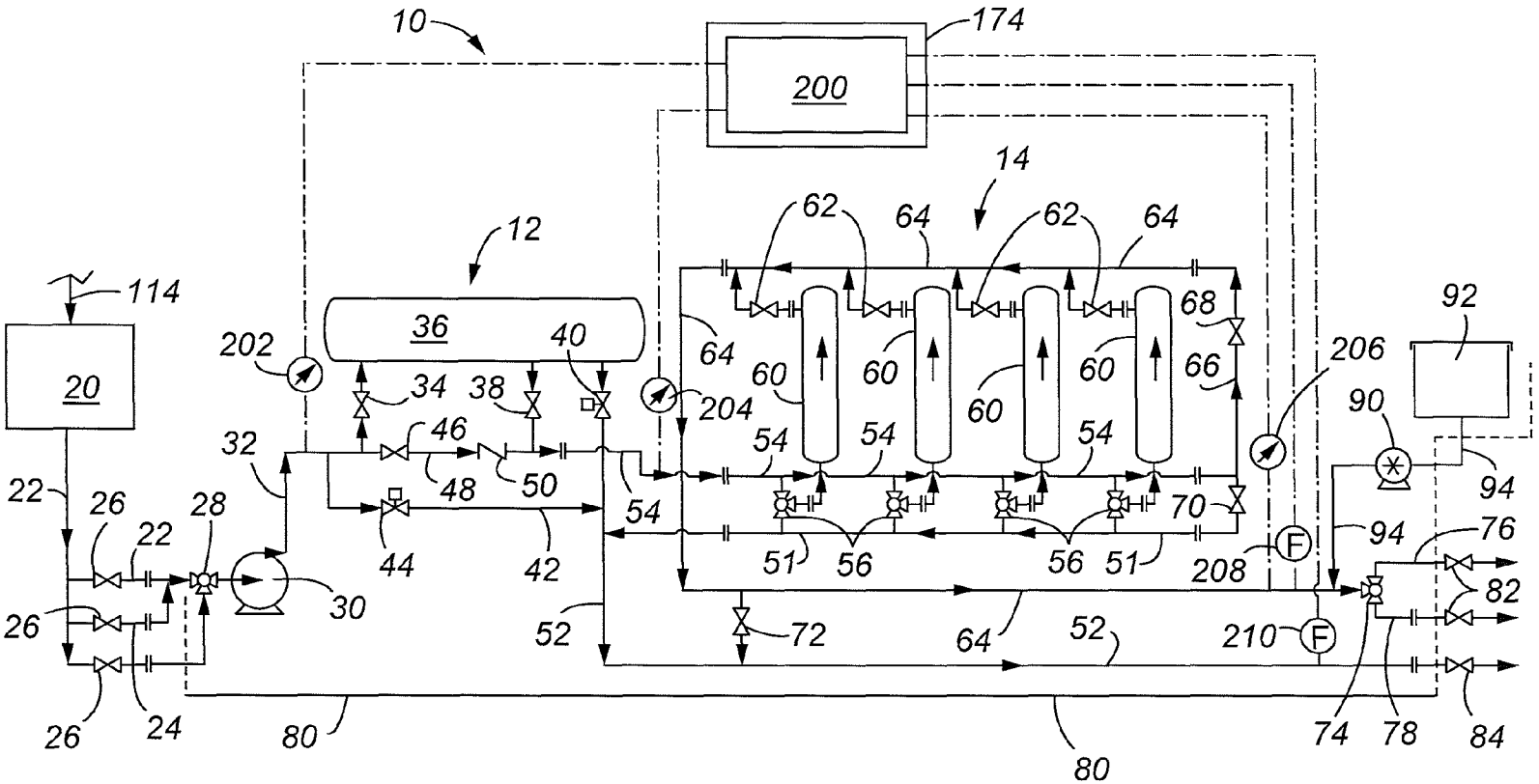
FIG. 3 is a schematic diagram of the filtration assembly of the system.
Figures 4, 5:
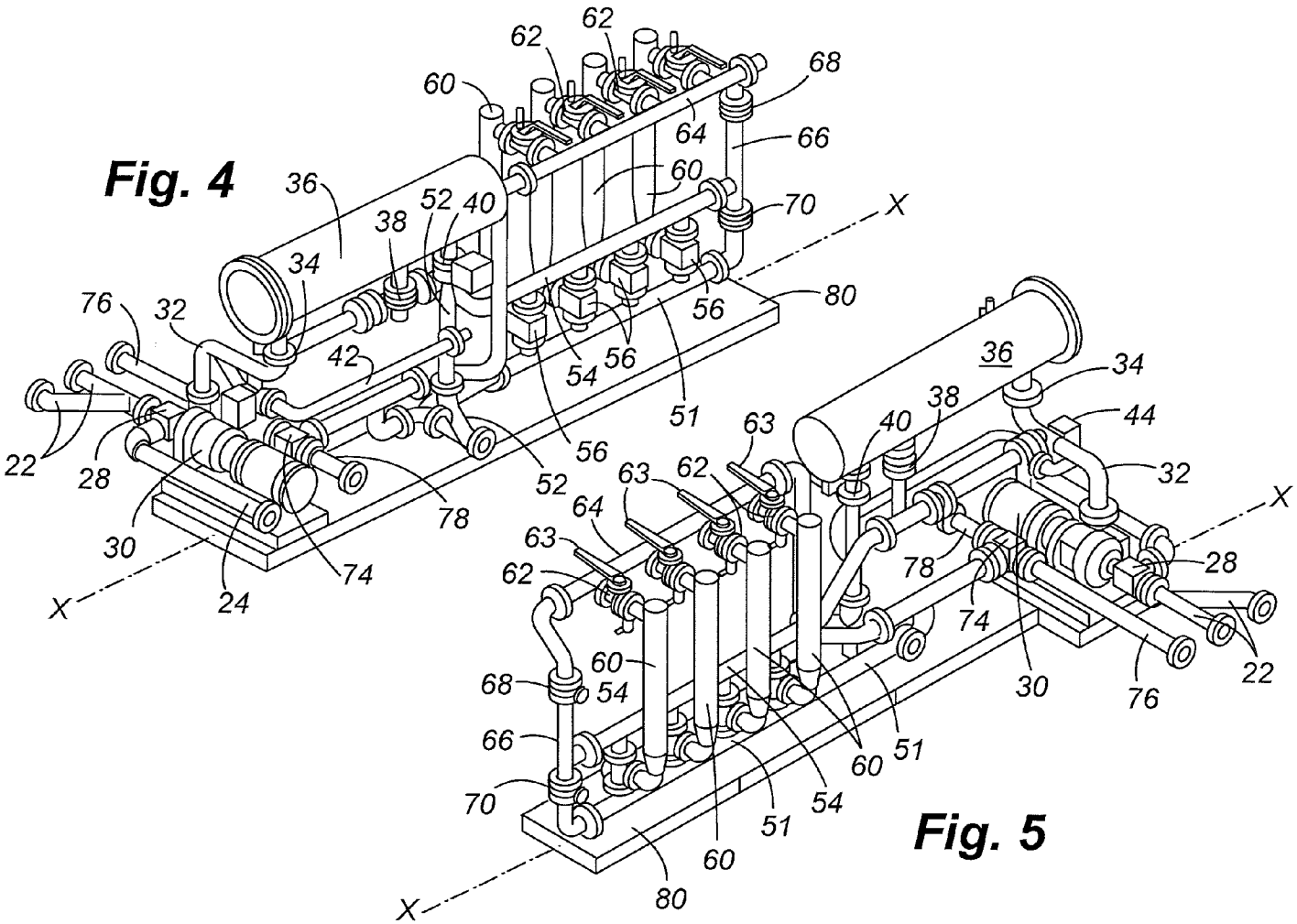
FIG. 4 is a perspective view of the filtration assembly.
FIG. 5 is a reverse perspective view of the filtration assembly.
Figure 6:
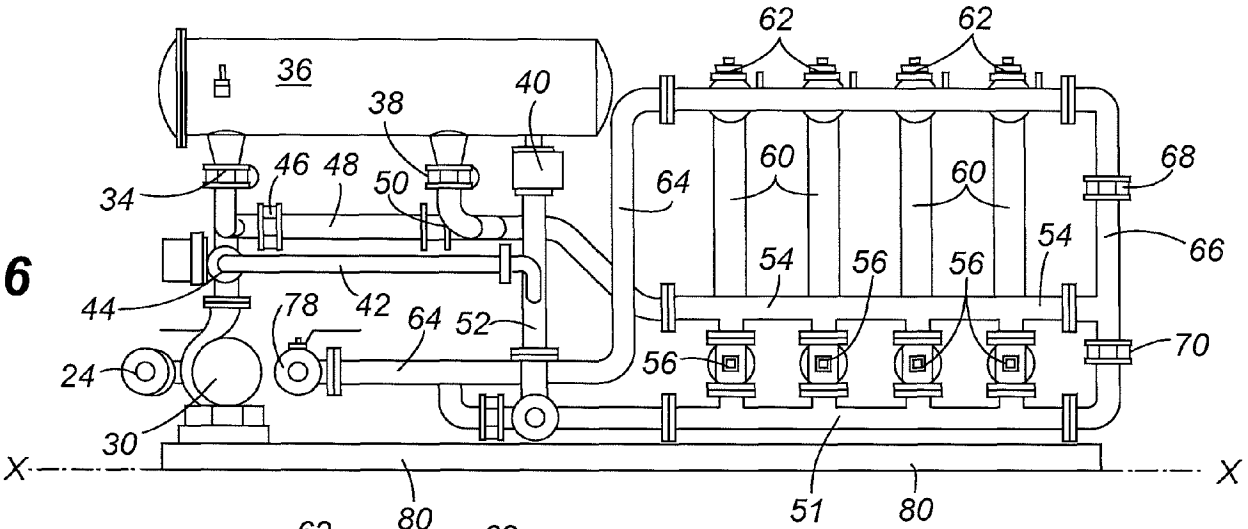
FIG. 6 is an elevation view of the filtration assembly.
Figure 7:
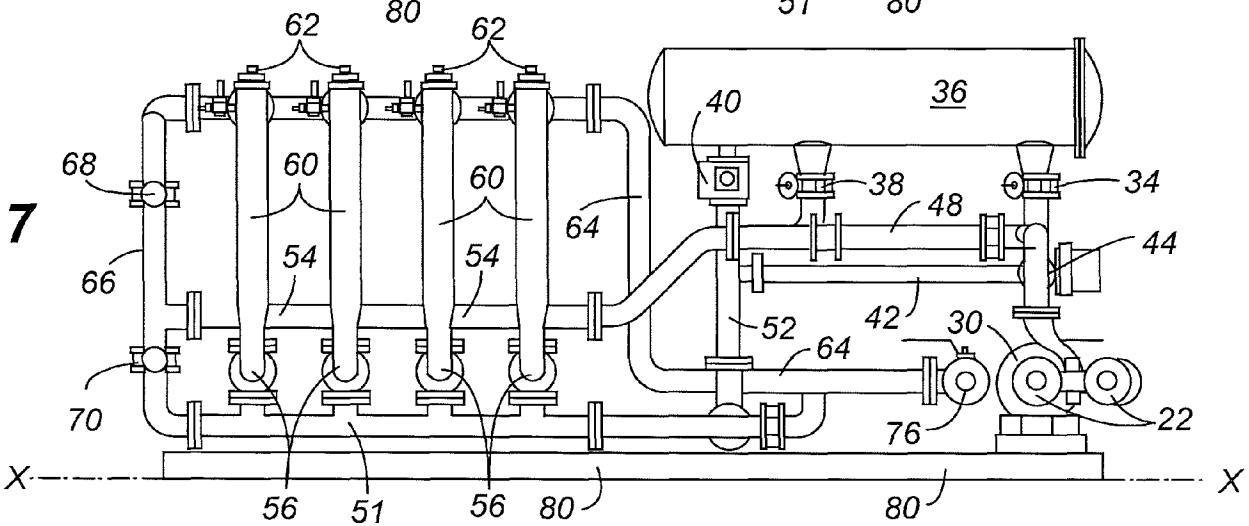
FIG. 7 is a reverse elevation view of the filtration assembly.

Referring to FIG. 3, a schematic diagram is provided of the filtration assembly 10 of the present invention. First, the transfer line 114 carries the spent/used cleaning fluid from the wellbore to the pre-treatment station 20. From the pre-treatment station, inlet line 22 carries the used fluid through one or more separate inlet valves 26. The used fluid then flows through three-way inlet valve 28 to pump 30. An alternate inlet (not shown) may be provided in the event there is more than one source of spent/used fluids, such as from multiple pre-treatment stations. Pump 30 conveys the used fluid through delivery line 32 to the primary filtration station 12. The primary filtration station 12 includes a primary filter 36. The used fluid enters the filter 36 through primary filter intake valve 34. The used fluid is filtered in the filter 36. The primary filtered fluid exits the filter 36 and travels through primary filter discharge valve 38 and then through primary filtered fluid line 54.

Primary filter 36 can be selected to provide the necessary coarse filtration. One example of a range of pore sizes for the filter 36 could be in the range of 10-25 microns. This range may provide adequate coarse filtration for many oil well applications however the particular range can be adjusted for the particular application. The primary filter 36 may also have an automatic backwash feature to periodically clean the filter. The construction of the filter element(s) within the filter 36 can also be chosen to maximize filtration results, and one example of a filter construction is one that has a woven wire mesh filter arrangement. In a backwash cycle, the filter is cleaned to remove the arrested contaminant particles, and primary filter backwash valve 40 is actuated to enable the backwash fluid containing the loosened particles from the filter to travel through primary waste line 52. Primary waste line 52 may also have its own dedicated discharge valve 84. The downstream side of the discharge valve communicates with a receptacle (not shown) which captures the waste concentrate.

A primary filter bypass line 48 is provided to enable fluid to bypass the primary filter 36. Primary filter bypass valve 46 is opened to receive the bypass fluid when primary filter intake valve 34 is closed to thereby facilitate the bypass. A check valve 50 is provided to prevent backflow through the bypass line 48. The bypass line 48 connects to the primary filtered fluid line allowing the fluid to flow directly to the secondary filtration station 14. This bypass function may be desirable when, for example, the used fluid does not require primary filtration to remove larger particles.

A diversion line 42 is also provided to divert a desired flow of fluid in order to flush the primary waste line 52, or to prevent freezing of the primary waste line 52 in the event the filtration assembly was inadvertently exposed to conditions which otherwise could freeze the lines. As shown, diversion line 42 connects to the primary waste line 52 downstream of diversion valve 44. Diversion valve 44 is opened to allow a desired amount of flow through diversion line 42 into the primary waste line 52. Thus, the diversion line 42 provides additional conveying fluid so that the concentrated waste does not obstruct line 52, since primary waste line 52 does not typically have a steady stream of fluid passing therethrough and the waste line is therefore more susceptible to becoming clogged by solids buildup.

From the primary filtered line 54, the primary filtered fluid then passes through the secondary filter inlet valves 56 into the secondary filtration station 14. The station 14 as shown comprises a plurality of secondary/fine filters 60. Within the plurality of fine filters 60, the final or secondary filtration occurs. One example of a range of pore sizes for the secondary filters 60 could be in the range of 3-5 microns. This range may provide adequate fine filtration for many oil well applications however this particular range can also be adjusted for the particular application. The finely filtered or secondary filtered fluid then passes through secondary filtrate discharge valves 62 and into the secondary filtrate line 64. Secondary filtrate line 64 then communicates with discharge valve 74, and the secondary filtered fluid is discharged through discharge line 76 and/or discharged through alternate discharge line 78. Final discharge valves 82 may be placed downstream from the discharge lines.

As also shown in the FIG. 3, an outlet diversion valve 72 is provided that interconnects the secondary filter fluid line with the primary waste line 52 thereby providing additional fluid for washing/flushing of the primary waste line 52.

If it is desired to bypass the secondary filtration station and deliver the primary filtered fluid for re-use at the well cleaning operation, and then the secondary filter inlet valves 56 are closed. The coarsely or primary filtered fluid passing through line 54 then passes through bypass line 66 and secondary bypass valve 68 is opened, enabling the fluid to then pass through the secondary filtrate line 64.

If it is desired to use the primary filtered fluid to flush the primary waste line 52, then the secondary filter inlet valves 56 are closed, secondary waste valve 70 is opened, and the fluid flows through secondary waste line 51. Secondary waste line 51 connects to primary waste line 52.

The secondary filters also have a backwash capability in which the filters may be cleaned, and the concentrated contaminants can be evacuated for waste disposal. More specifically, when a backwash cycle occurs, the backwash liquid is discharged from the secondary filters 60 back through the three way secondary filter inlet valves 56 into the secondary waste line 51 thereby allowing the concentrated waste to be finally evacuated.

FIG. 3 shows the major portion of the filtration assembly being mounted on a piping skid 80. As discussed below, the skid mounted filtration assembly is advantageous in allowing the assembly to be easily installed in and removed from the enclosure 160.

FIG. 3 also illustrates a basic control scheme including the master controller 200 that can be housed within the main control panel 174. It is one object of the invention to provide a comprehensive control scheme that allows unattended operation of the system. The control scheme as illustrated comprises various inputs including a first pressure reading 202 at the inlet of the primary filtration station, a downstream pressure reading 204 located just downstream from the primary filtration station, and another downstream pressure reading 206 located just downstream from the secondary filtration station. The pressure reading 204 is also used as the inlet pressure reading for the secondary filtration station. The control scheme in the FIG. 3 also illustrates two flow monitors, one flow monitor 208 positioned to measure fluid flow within the secondary filtered fluid line 64, and another flow monitor 210 located to measure fluid flow within the primary waste line 52. The pressures recorded at these designated locations, along with the flow rates measured, enables a software/firmware application in the controller 200 to monitor the desirable flow of liquid through the filtration assembly. The control scheme also includes various outputs to include solenoids or other electrical or pneumatic actuators to open, close and otherwise modulate the position of the valves in order to achieve a desired sequence of continuous filtration, backwash cycling, flushing of the waste lines, etc. The control system is also capable of other functions such as automatic shutdown in the event of an alarm condition, and generating alarms such as gas and fire detection events. Manual and automatic emergency shutdown can be provided in the event of triggering alarm conditions. Some of the safety measures and remedial actions that can be incorporated in the system and which can also be monitored by the controller 200 include overpressure protection sensors on all filtration vessels, fire and gas detectors, and pneumatic purge of all panels and habitable spaces in the event of the detection of high levels of volatile gases. Timers and various other sensors can be added to the control system to monitor the operation of the system. The system is intended to operate in classified hazardous environments, therefore the monitoring capabilities of the invention are provided to comply with regulations concerning operation of the system in such hazardous environments. The controller may include communication elements such as a wireless interface that allows an operator to remotely control the system. Thus, the system can also be integrated within a communications system in which the software/firmware is web-based and allows remote operation and control of the system. Accordingly, it is also contemplated that the software/firmware provides a number of user interfaces that allows a user to view operation of the system and to send commands to modify operation of the system. Particularly advantageous user interfaces include those graphical user interfaces that provide a visual depiction of the system during operation and the various parameters measured by input devices incorporated in the system. Incorporation of the controller into a wireless communications system is ideal for operation of the system in remote locations.

FIG. 3 also illustrates a tank 92 that stores treatment chemical(s) to be added to the filtrate stream. A dosing pump 90 introduces treatment chemicals/conditioners through line 94 into the secondary filtrate line 64. The dosing pump meters a desired quantity of the chemicals/conditioners and the dosing pump can also be controlled by the master controller 200. Thus, the filtered fluid stream can be further conditioned/treated to meet the needs of the specific wellbore being cleaned. FIG. 3 illustrates the chemical tank and pump 90 being mounted on the skid/platform 80. FIG. 2 does not illustrate the tank and pump, but it shall be understood that the tank and pump could be mounted in a number of locations to include open floor space within the filter assembly room.

FIGS. 4-7 illustrate the filtration assembly 10 in a preferred embodiment. For clarity purposes, not all of the components labeled in the schematic diagram of FIG. 3 are labeled in FIGS. 4-7. Furthermore, some of the elements shown in the FIG. 3 are not also illustrated in FIGS. 4-7 to include valves 26, 82 and 84, pump 90, line 94, and chemical tank 92. Some or all of these elements not shown in FIGS. 4-7 can be mounted to the trailer/vehicle that carries the enclosure 160.

The filtration assembly 10 is preferably mounted on the piping skid or base 80 that allows the assembly to be easily manipulated as a single unit. Thus, the intention of the filtration assembly design is to provide a modular, integral unit that can be more easily installed, removed, repaired, and transported. FIGS. 4-7 also illustrate that the filtration assembly has a very narrow, linear profile in which the filtration assembly is especially adapted for fitting within the one room of the enclosure 160. More specifically, the filtration assembly is arranged so that the primary filter 36 extends along a longitudinal axis X-X. The secondary filters 60 extend vertically, and are spaced from one another in a linear fashion and substantially parallel to the axis. The filtrate lines, diversion lines, and waste lines are also oriented along or substantially parallel to the axis, thereby maintaining the relatively narrow profile along the axis. In the preferred embodiment, the pump 30 is arranged substantially perpendicular to the axis that enables both the inlet and discharge lines to be accessed along one of the longer sidewalls of the enclosure. However, this arrangement of the pump does not substantially alter the narrow, linear configuration of the filtration assembly, as the pump 30 occupies only a slightly greater amount of the piping skid 80 to which the filtration assembly is mounted. It should also be understood however that the pump 30 could be rotated 90 degrees so that it resides primarily under the primary filter 30 and, therefore, the discharge and inlet lines would extend parallel with the longitudinal axis.

FIGS. 4-7 do not illustrate a system of pipe hangers/supports; however, it shall be understood that the invention comprises a plurality of pipe supports in which the lower ends of the pipe supports are secured to the piping skid 80. In this manner, the pipe hangars are less intrusive in terms of occupying space since they are confined primarily to the profile of the skid, and the operator maintains the ability to access all sides of the filtration assembly without obstruction.

FIGS. 4-7 illustrate the valves 62 as being hand-operated as by inclusion of lever handles 63, while the remaining valves are illustrated without lever handles. It shall be understood that selected valves may be manually operated, or all of the valves may be automatically controlled by use of solenoids or other electrically or pneumatically controlled actuators.

The advantages of the present invention are quite apparent. A compact, automated, transportable, and self-sufficient recirculation and filtration system is provided. The system is automated and allows the system to run unattended for significant periods of time. This system can be mounted to a trailer or hauling vehicle platform that is not over-sized, which greatly eases transporting requirements by not requiring any special transportation permits. The enclosure provides a habitable space for operators to efficiently inspect, troubleshoot, and repair the system. The enclosure can be insulated for use in severe climatic conditions. Selected addition of chemicals/conditioners allows the system to not only handle removal of contaminants, but to also treat the cleaning fluid for a desired application. The enclosure can be towed, for example, by a vehicle which includes a coiled tubing dispenser. Thus, the system can also be considered in combination with a coiled tubing dispenser and therefore in another aspect of the invention, it includes the integrated fluid filtration and recirculation system along with a coiled tubing dispenser.

Although the system and method of the present invention have been provided in preferred embodiments, it shall be understood that various other changes and modifications can be made to the invention commensurate with the scope of the claims appended hereto.

What is claimed is:

1. A method of providing integrated fluid filtration and recirculation for cleaning fluid used to clean a wellbore, said method comprising:

providing (i) an enclosure having at least two rooms, said enclosure comprising a main pallet forming a floor, sidewalls, and a roof; (ii) an electrical power generator located in one room; (iii) a filtration assembly located in the other room, said filtration assembly comprising: a primary filter; a plurality of secondary filters spaced longitudinally from one another and substantially aligned along an axis; a plurality of filtrate lines; a plurality of bypass lines; and at least one waste line; wherein said filtration assembly is arranged for primary and secondary filtration of a liquid stream flowing through the primary and secondary filters; (iv) at least one filtration pump for conveying said fluid through said filtration assembly and wherein said primary filter, said secondary filters, said pump, and said electrical power generator are substantially aligned along the axis thereby minimizing a profile of said filtration assembly; and (v) a main controller for providing control of said electrical power generator and said filtration assembly;

receiving a liquid stream into said filtration assembly from a pre-treatment station;

conducting primary filtration of the liquid stream through said primary filter;

conducting secondary filtration of the liquid stream through said second filter;

adding treatment chemicals to the liquid stream to selectively condition the liquid stream; and conveying the liquid stream back to the well for subsequent use of the liquid stream in a cleaning operation of the well.

2. A method, as claimed in claim 1, wherein:

said main controller receives pressure and flow inputs based on measured parameters of operation of said filtration assembly, and said main controller provides outputs including signals to control a plurality of valves incorporated in said filtration assembly which dictate flow paths and volumes of the liquid flowing through the assembly.

3. A method, as claimed in claim 1, further including:

a dosing pump for supplying an amount of a treatment chemical to the filtered liquid stream.

* * * * *